US007546729B2

(12) United States Patent
Palmer et al.

(10) Patent No.: US 7,546,729 B2
(45) Date of Patent: Jun. 16, 2009

(54) METHOD AND SYSTEM FOR LIMITING TORQUE LOAD ASSOCIATED WITH AN IMPLEMENT

(75) Inventors: Marvin Kent Palmer, Oswego, IL (US); Steven Conrad Budde, Dunlap, IL (US); SriVidya Lavanya Kamisetty, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 223 days.

(21) Appl. No.: 11/640,184

(22) Filed: Dec. 18, 2006

(65) Prior Publication Data

US 2008/0142232 A1 Jun. 19, 2008

(51) Int. Cl.
*F16D 31/02* (2006.01)

(52) U.S. Cl. ..... 60/449; 60/328; 60/446; 60/463

(58) Field of Classification Search ..... 60/328, 60/433, 434, 446, 449, 463
See application file for complete search history.

(56) References Cited

U.S. PATENT DOCUMENTS 5,305,681 A * 4/1994 Devier et al. ..... 60/463
5,511,458 A 4/1996 Kamata et al.
5,701,793 A 12/1997 Gardner et al.
5,875,701 A 3/1999 Cobo et al.
6,047,228 A 4/2000 Stone et al.
6,073,442 A * 6/2000 Creger et al. ..... 60/446
2005/0241304 A1 11/2005 Bankestad et al.
2006/0018765 A1 1/2006 Fransson et al.
2006/0200300 A1 * 9/2006 Bryan et al. ..... 701/112

FOREIGN PATENT DOCUMENTS

WO WO 2006/011835 A1 2/2006

* cited by examiner

*Primary Examiner*—Michael Leslie
(74) *Attorney, Agent, or Firm*—Finnegan, Henderson, Farabow, Garrett & Dunner

(57) ABSTRACT

A method for reducing a torque load associated with an implement includes determining a speed associated with a power source, wherein the power source is configured to provide power to a hydraulic pump, determining a position associated with an implement system, and limiting a flow associated with the hydraulic pump based on the speed associated with the power source and the position associated with the implement system.

18 Claims, 3 Drawing Sheets

METHOD AND SYSTEM FOR LIMITING TORQUE LOAD ASSOCIATED WITH AN IMPLEMENT

TECHNICAL FIELD

This disclosure relates generally to limiting torque load associated with an implement and, more particularly, to a system and method for limiting torque load associated with an implement based on power source speed and implement position.

BACKGROUND

Machines such as, for example, dozers, loaders, excavators, motor graders, and other types of heavy machinery use linkage systems to accomplish a variety of tasks. These linkage systems often include hydraulic cylinders. Problems can be encountered in the operation of a hydraulic cylinder if a piston within the hydraulic cylinder impacts against an end structure of the hydraulic cylinder. Such impacts can cause undesirable noise, and damage to the cylinder or other components of the linkage system.

Limiting the motion of an implement (i.e., snubbing) has been utilized to limit damage and noise associated with such implement operation. Limiting may have two steps: (1) determining when to limit motion and (2) limiting the motion of the implement. In the past limiting has been performed to stop the cylinders before cylinder end-of-travel and/or to stop the linkage before it reaches a hard stop (e.g., before a bucket implement contacts the linkage). Therefore, determining when to limit may involve determining cylinder position, linkage position, or other positional factors. Further, limiting has been accomplished by slowing down a hydraulic pump and/or by closing a valve through which the pressurized hydraulic fluid flows to the implement cylinders.

A variety of systems (e.g., sensors and electro-hydraulic devices) have been used to effect the limiting of the implement motion when the implement nears a stop point (e.g., end-of-travel of the linkage and/or cylinder). These systems can include cylinder position sensors that are in communication with electronically actuated hydraulic valves. For example, U.S. Pat. No. 5,701,793 (the '793 patent) issued to Gardner et al. on Dec. 30, 1997, describes an apparatus for controllably moving a work implement. A joystick position sensor senses the position of the control joystick, while a implement cylinder detecting means provide information to a controller. This information is processed and a signal sent to a valve for driving a hydraulic cylinder (i.e., the cylinder control means) to control flow into and out of the cylinder.

Although the fluid cylinder system of the '793 patent may provide position and velocity information for controlling electronically actuated hydraulic valves to mitigate impacts (e.g., noise and damage to cylinders), the fluid cylinder system operates at all times (i.e., no determination of when limiting should be turned off), which may cause operator frustration and a loss of productivity because of a slowing implement as the implement nears a stop point.

The present disclosure is directed at overcoming one or more of the problems or disadvantages in the prior art control systems.

SUMMARY OF THE INVENTION

In one aspect, the present disclosure is directed to a method for reducing a torque load associated with an implement. The method may include determining a speed associated with a power source, wherein the power source is configured to provide power to a hydraulic pump and determining a position associated with an implement system. The method may further include limiting a flow associated with the hydraulic pump based on the speed associated with the power source and the position associated with the implement system.

In another aspect, the present disclosure is directed to a system for reducing a torque load associated with an implement. The system may include a controller communicatively connected to a power source, a first sensor configured to sense a speed associated with the power source, and a second sensor configured to sense a position of an implement system, wherein the power source is operatively connected to a hydraulic pump and configured to provide power to the hydraulic pump. The controller may be configured to determine the speed associated with the power source based on input from the first sensor, determine a position associated with the implement system based on input from the second sensor, and generate a signal based on the speed associated with the power source and the position associated with the implement system, wherein the signal affects a flow of fluid associated with the hydraulic pump.

In yet another aspect, the present disclosure is directed to a method of limiting the motion of a hydraulic cylinder on a machine. The method may include sensing a speed associated with a power source, wherein the power source is related to a machine and configured to drive a hydraulic pump associated with the machine and sensing a position associated with an implement system, wherein the implement system is associated with the machine, a hydraulic cylinder, and the hydraulic pump. The method may further include receiving a command to provide a flow of fluid from the hydraulic pump to the implement system to impart motion to the implement system and reducing the flow of fluid from the hydraulic pump, resulting in a reduced velocity of the implement system, when the speed associated with the power source falls below a power source speed threshold and the position associated with the linkage falls within a predetermined positional proximity of a stop point associated with the implement system.

DETAILED DESCRIPTION

Figure 1:
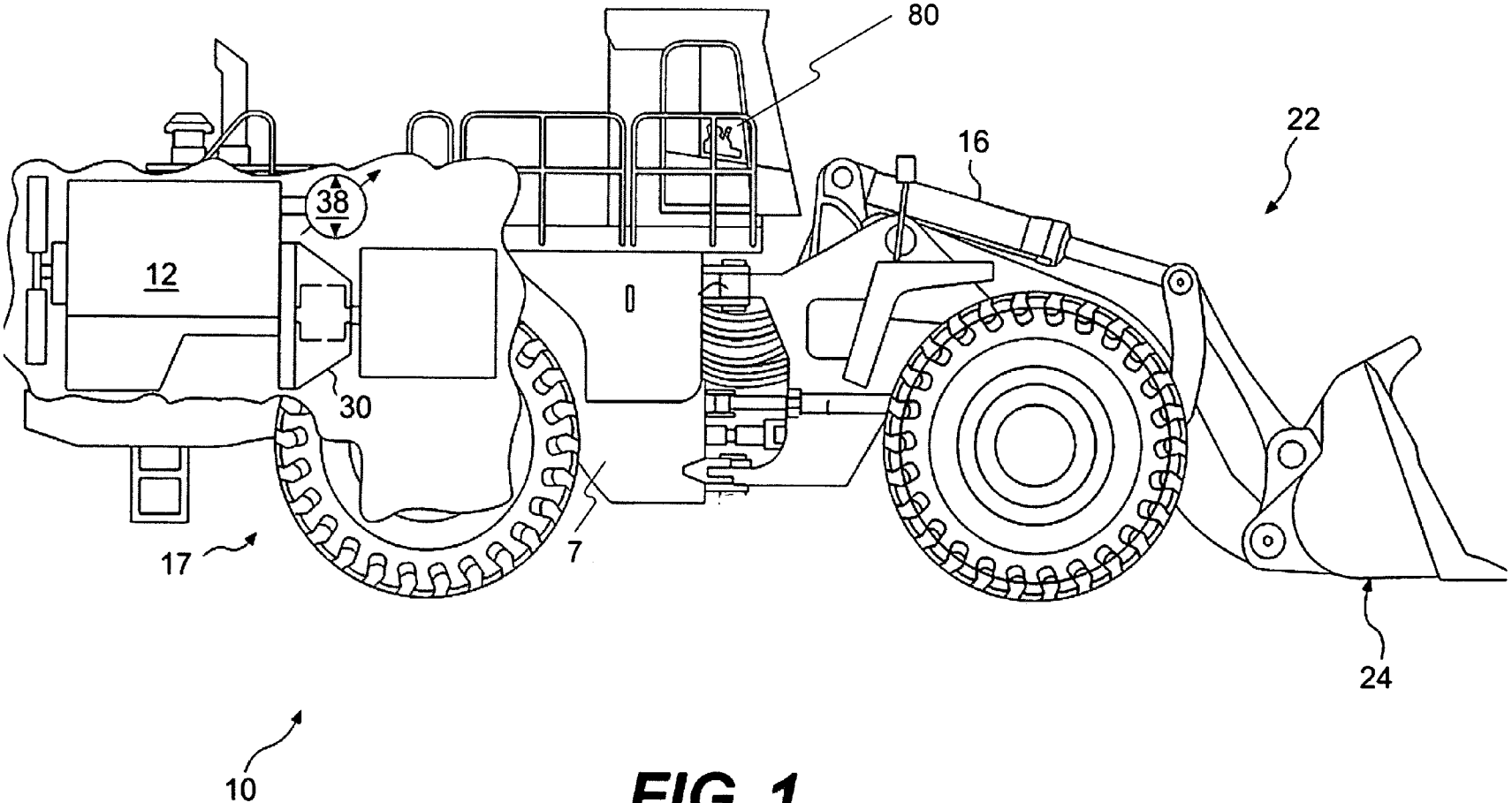
FIG. 1 illustrates an exemplary embodiment of a machine.

FIG. 1 illustrates an exemplary embodiment of a machine 10. Machine 10 may be a mobile machine that performs some type of operation associated with an industry such as mining, construction, farming, or any other industry known in the art. For example, machine 10 may be an earth moving machine such as a wheel loader, a dump truck, a backhoe, a motor grader, or any other suitable machine. Machine 10 may include a power source 12, a frame 7, an operator interface 80, a hydraulic pump 38, and a transmission 30 connected to at least one driven traction device 17. Machine 10 may further include one or more implement systems 22.

Power source 12 may be an engine such as, for example, a diesel engine, a gasoline engine, a gaseous fuel powered engine such as a natural gas engine, or any other engine apparent to one skilled in the art. Power source 12 may also embody another source of power such as a fuel cell, a power storage device, or any other source of power known in the art.

Power source 12 may include sensors configured to sense, among other things, a proximity to an engine stall condition. Such sensors may include a speed sensor or other sensor associated with power source 12 and configured to sense when power source 12 may be in a condition to stall (e.g., high load and low power source speed). Such sensors may include electrical and/or mechanical sensors or any combination thereof. For example, a magnetic pickup may be mounted near a flywheel associated with power source 12 such that a magnet on the flywheel may trigger a response in the pickup for each rotation of the flywheel.

Implement system 22 may include an implement 24 for performing various tasks including, for example, loading, compacting, lifting, brushing, and other desired tasks. Implement 24 may include numerous devices such as, for example, buckets, compactors, forked lifting devices, brushes, or other suitable devices as desired for accomplishing particular tasks. For example, machine 10 may be tasked to moving excavated earth from one point to another at a mine or similar site. Such an arrangement may be conducive to utilizing a bucket loader implement similar to that shown as implement 24. Further implement system 22 may accomplish such tasks by imparting various motions to implement 24. Such motions may include, for example, rotating, extending, raising, lowering, tilting, and other suitable motions.

Implement system 22 and implement 24 may be designed with numerous stop points associated with movements of implement system 22 and implement 24. Stop point, as used herein, shall mean any point and/or position associated with linkages, cylinders, and any other elements of an implement or implement system that may be undesirable or difficult for implement system 22 or implement 24 to move through. Such stop points may be based on, for example, hydraulic cylinder end-of-travel points, linkage contact points, implement contact points with linkages, mechanical safety stops, design preferences, and/or any other suitable elements and factors. For example, implement system 22 may be limited to extending 15 feet from machine 10 prior to a hydraulic cylinder piston reaching its end-of-travel point. In another example, implement 24 (e.g., a bucket) may be limited to 140 degrees of rotation/tilt about a pivot point before contacting a mechanical safety stop. One of skill in the art will recognize that other factors may be used in determining and/or creating a stop point of implement system 22 and implement 24 without departing from the scope of the present disclosure.

Implement system 22 may further include one or more implement hydraulic cylinders 16 for imparting motion to various portions of implement system 22 (e.g., lifting, tilting, and/or rotating implement 24). Implement hydraulic cylinders 16 may work in cooperation with various linkages associated with implement system 22 to effect a desired motion. Motion of implement system 22 may be imparted via extension and retraction of pistons associated with the one or more implement hydraulic cylinders 16.

Implement system 22 may also include one or more mechanical safety stops (not shown) configured to create a stop point or prevent various types of linkage contact. These stops may be affixed at various points on implement system (e.g., bucket racks) and may include steel, rubber, and other materials with sufficient strength to stop motion associated with implement system 22 and/or implement 24.

Implement system 22 may also include sensing mechanisms designed to sense motion, position, and velocity, among other things, associated with implement system 22. Such sensors may include electrical and/or mechanical sensors or any combination thereof. For example, implement hydraulic cylinder 16 may include a position sensor configured to transmit data related to a position associated with implement 24. Such position data may further be indicative of a position of a piston within hydraulic cylinder 16. In addition, other sensors may sense an angle of a linkage associated with implement system 22 and/or implement 24, a position of a linkage associated with implement system 22 and/or implement 24, and/or any other suitable characteristic of implement system 22 and/or implement 24. Utilizing such positional data, it may be possible to calculate positional proximity to a stop point associated with implement system 22 and/or implement 24, among other things. It is important to note that one of skill in the art will recognize that numerous methods for calculating positions of dynamic linkages and hydraulic cylinders based on sensor data exist in the art. Any and all such methods are contemplated by the present disclosure.

Operator interface 80 may be located within an operator cabin of machine 10, in close proximity to a seat (not shown), and may include numerous devices to control the components, features, and functions of machine 10. In one example, operator interface 80 may include a joystick controller 82 (not shown in FIG. 1). It is contemplated that operator interface 80 may include additional or different control devices such as, for example, levers, switches, buttons, pedals, wheels, and other control devices known in the art.

Joystick controller 82 may be configured to control a movement of implement system 22. In particular, joystick controller 82 may be tiltable about at least one axis and travel speed proportional. For example, joystick controller 82 may be tiltable in a forward position relative to a machine operator to cause movement of implement system 22 in a first direction. Joystick controller 82 may also be tiltable in a rearward position relative to the machine operator to cause movement of implement system 22 in a second direction opposite to the first direction. Joystick controller 82 may have a maximum tilt angle limit (full command) and a minimum tilt angle limit (no command) in both the forward and rearward directions and may be tiltable to any angle between the maximum and minimum positions to move implement system 22 at a corresponding speed between a maximum and minimum travel speed in the associated direction. The ratio of the percent of maximum travel speed to the percent of maximum tilt angle of joystick controller 82 may be considered an implement movement speed gain. It is contemplated that joystick controller 82 may be tiltable about multiple axes, twistable, and/or movable in any other manner. It is further contemplated that joystick controller 82 may be configured to control additional functions associated with machine 10 other than movement of implement system 22. It is also contemplated that the movement of implement system 22 may be controlled by a control device other than joystick controller 82 such as, for example, a slide mechanism, a wheel mechanism, a pedal, or any other appropriate device.

Figure 2:
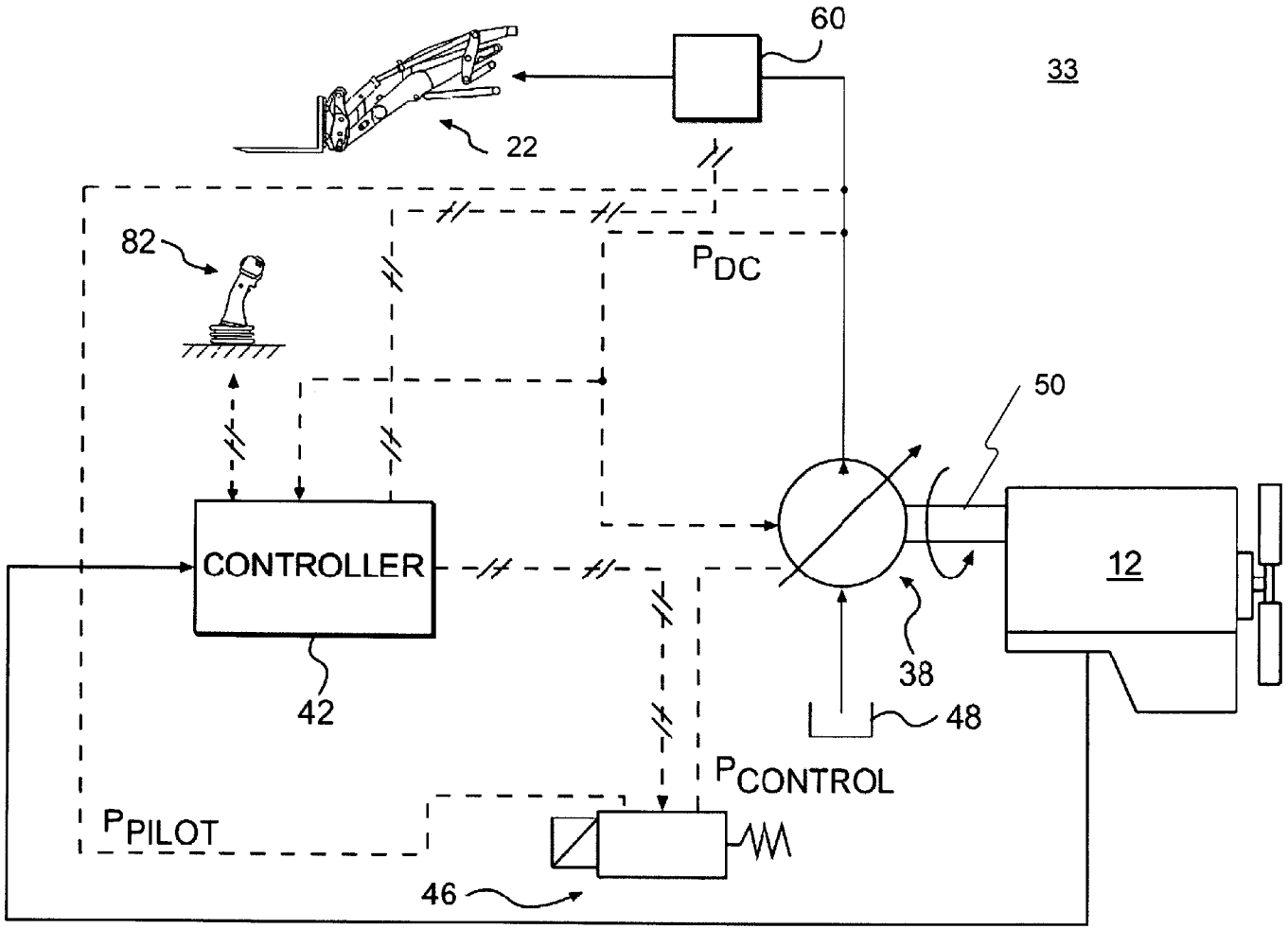
FIG. 2 illustrates a high level hydraulic schematic consistent with an embodiment of the present disclosure.

FIG. 2 is a high level schematic of an exemplary hydraulic circuit that may be utilized with machine 10. Machine 10 may include a hydraulic circuit 33 fluidly connected to an implement circuit configured to impart motion to implement system 22. Although FIG. 2 illustrates hydraulic circuit 33 being dedicated to supplying pressurized fluid to an implement system 22, it is contemplated that hydraulic circuit 33 may alternately supply pressurized fluid to more or fewer machine hydraulic circuits as desired (e.g., a steering circuit). Hydraulic circuit 33 may include a hydraulic pump 38, a directional control valve 60, a flow-control assembly (not shown), and a controller 42, among other things.

Hydraulic pump 38 may be configured to draw a fluid from a reservoir 48 and produce a flow of fluid at a particular discharge pressure. In so doing, hydraulic pump 38 may exert a torque on power source 12. This torque may be calculated based on a discharge pressure of the pump (i.e., $P_{dc}$) and an associated flow rate of pressurized hydraulic fluid from the pump. Hydraulic pump 38 may include a variable displacement pump, a variable flow pump, or any other device for pressurizing a flow of fluid known in the art. For example, hydraulic pump 38 may be a variable displacement pump including a pump-flow control component such as a swash plate configured to vary the stroke of one or more pistons associated with the pump. By varying the stroke of the one or more pistons, maximum pump flow may be increased or decrease as desired, thereby increasing or decreasing the resulting maximum pump torque that may be applied to power source 12. Therefore, torque may also be calculated based on the angle of the swash plate associated with hydraulic pump 38 and flow control assembly (not shown). Maximum pump torque, as used herein, will be understood to mean the maximum torque that may be applied by hydraulic pump 38 to power source 12 at any particular discharge pressure with pump 38 operating at a flow rate based on a swash plate angle.

Hydraulic pump 38 may be operatively connected to power source 12 by, for example, a countershaft 50, a belt (not shown), an electrical circuit (not shown), or in any other suitable manner. Additionally, pressurized fluid from hydraulic pump 38 may be supplied to numerous signal pressure circuits included with machine 10. For example, a pump discharge pressure ($P_{dc}$) associated with hydraulic pump 38 may be used as a load-sense signal and provided to controller 42, hydraulic pump 38, and/or other suitable devices.

Hydraulic pump 38 may be configured to receive pressure signals indicating adjustments to operational parameters (e.g., flow rate) of hydraulic pump 38. Such pressure signals may include, for example, a discharge pressure signal ($P_{dc}$) and a flow adjustment signal ($P_{control}$). For example, $P_{dc}$ may be indicative of the load associated with hydraulic pump 38, while $P_{control}$ may be indicative of a flow rate modification to hydraulic pump 38. Feeding back such pressure signals to hydraulic pump 38 may cause associated increases or decreases in fluid flow (e.g., by causing angular variation in a swash plate associated with pump 38).

One or more directional control valves 60 may be fluidly connected within hydraulic circuit 33 and configured to direct a flow of pressurized fluid to implement system 22 based on an operator command (e.g., input from joystick controller 82). Directional control valves 60 may include spool valves, shuttle valves, or any other suitable control-type valve and may include hydraulic and/or electro-hydraulic actuation means. Directional control valves 60 may be configured to vary a volume and direction of a flow of pressurized fluid from hydraulic pump 38 to implement system 22. In one embodiment, the volume and direction of flow directed to implement system 22 by directional control valve 60 may be correlated in part to an input from joystick controller 82. In such an embodiment, a command from joystick controller 82 may be transmitted to controller 42 or other suitable device. Controller 42 may translate the command into an appropriate signal and provide the signal to directional control valve 60. Directional control valve 60 may then respond in accordance with the received signal. The position of directional control valve 60 may vary from fully closed when joystick controller 82 is at its minimum position, to fully open (full command) from hydraulic pump 38 when joystick controller 82 is at its maximum position in any particular direction.

Additionally, one or more valves configured to provide pressure signals (e.g., $P_{dc}$) to other portions of hydraulic circuit 33 and/or other hydraulic circuits may be fluidly connected within hydraulic circuit 33. Such valves may include shuttle valves, directional valves, pressure reducing valves, pressure relief valves, and/or other suitable devices. While $P_{pilot}$ is shown as being supplied from hydraulic pump 38, $P_{pilot}$ may be supplied from any other suitable source of pressurized fluid associated with machine 10. For example, $P_{pilot}$ may be supplied by load sense pressure sensor (not shown), a hydraulic fan circuit, a powered lift circuit, or any other suitable source.

Pump-flow modifying component (not shown) may be configured to adjust a maximum flow of pressurized hydraulic fluid associated with hydraulic pump 38 based on a flow adjustment signal $P_{control}$. In one embodiment, pump-flow modifying component may include an adjustable swash plate internal to hydraulic pump 38. In such an embodiment an angle associated with the swash plate may affect maximum pump flow by varying a stroke length of reciprocating pistons producing the pressurized fluid flow. One of ordinary skill in the art will recognize that other pump-flow modifying components (or methods) may be used. For example, it may be desired to control pump flow via a pump speed modulator or other suitable device.

Controller 42 may be a mechanical or an electrical based controller configured to receive and/or determine operating parameters associated with power source 12, hydraulic pump 38, and implement system 22, among other things. For example, controller 42 may be communicatively connected to sensors associated with implement system 22 and/or implement 24, thereby enabling controller 42 to determine positions and velocities associated with implement system 22 and/or implement 24 based on sensor data. This may further enable controller 42 to determine when positions associated with implement system 22 and/or implement 24 are within a proximity of a stop point. Further, controller 42 may be communicatively connected to sensors associated with power source 12 such that controller 42 may determine a speed (e.g., RPM) of power source 12 and/or conditions when power source 12 may be at risk of stalling.

Controller 42 may further be communicatively connected to flow-control assembly (not shown) and directional control valve 60. Controller 42 may further be configured to generate and provide a control signal including various characteristics based on the received parameters to flow-control assembly (not shown). Characteristics of the control signal may include, for example, voltage, current, frequency, and/or other suitable characteristics. In one embodiment, controller 42 may be configured to vary a current and/or a voltage characteristic of the control signal based on the speed associated with power source 12 and the position associated with implement system 22. In such an embodiment, when the speed associated with the power source falls below a predetermined threshold speed and the positional proximity to a stop point associated with implement system 22 and/or implement 24 falls within a predetermined range, controller 42 may cause a reduction in a flow associated with hydraulic pump 38 by modifying a control signal to include a current at 2 amps.

Controller 42 may store data and algorithms related to power source speeds, operational lengths of implement system 22, positional proximities to stop points associated with implement system 22 and/or implement 25, power source torque output, fluid flow rates associated with hydraulic pump 38, operational velocities and associated flow rates for implement system 22, and control signal characteristics, among other things. Such data may be stored in memory or other suitable storage location and may enable a determination of flow reduction that may be applied based on power source speed and implement position/velocity. Data may be experimentally collected and based on power source size, speed (i.e., rotations per minute (RPM)), and/or implement loading, among other things. Such data may be stored in a lookup table within controller 42 for reference and/or portions of data may be calculated using algorithms stored within controller 42 and based on similar parameters. For example, controller 42 may contain data indicating that the minimum positional proximity to a stop point associated with implement system 22 and/or implement 24 is delta. Controller 42 may also contain data indicating that at a predetermined threshold speed of power source 12 (e.g., 900 RPM), fluid flow to implement system 22 should be reduced (i.e., snubbed) to limit a torque that may be applied to power source 12 upon stoppage of motion. Controller 42 may, therefore, contain algorithms for determining an appropriate response for causing a desired reduction in flow to implement system 22 and/or implement 24. In one embodiment, controller 42 may provide a control signal to flow-control assembly (not shown) indicating that the maximum flow of hydraulic pump 38 should be reduced. For example, using the situation described above, controller 42 may send a control signal including a current of 2 amps to flow-control assembly (not shown) causing flow control assembly to manipulate $P_{control}$ to affect a reduction of flow from hydraulic pump 38 such that the motion of implement system 22 is slowed or stopped. In another embodiment, controller 42 may cause the command received from joystick controller 82 to be limited and/or scaled (e.g., reduced) such that directional control valve 60 causes a flow less than would be normally commanded by such a position of joystick controller 82. It is important to note that the reduction of flow may be affected progressively or in one operation. For example, as the positional proximity of implement system 22 and/or implement 24 travels further below delta, flow to implement system 22 may be increasingly reduced for each successive unit of position below delta.

One of ordinary skill in the art will recognize that numerous other characteristics of a control signal may be utilized based on the monitored parameters. For example, controller 42 may determine that, based on a particular speed associated with power source 12 and a positional proximity to a stop point associated with implement system 22 and/or implement 24, a control signal should possess characteristics of 12 volts and 1.0 amps. Such a determination may be made utilizing stored data, active calculations, or other suitable methods.

While controller 42 is depicted as a single entity, it is contemplated that one or more controllers may carry out functions associated with controller 42. For example, one controller may monitor variables associated with power source 12 while another controller may monitor sensors associated with implement system 22.

INDUSTRIAL APPLICABILITY

The disclosed systems and methods may be applicable to any powered system that includes an implement and a hydraulic pump. The disclosed systems and methods may allow for controlling hydraulic fluid flow to an implement based on a speed associated with power source 12 and a position associated with implement system 22. In particular, the disclosed systems and methods may assist in reducing operator and machine stresses, reducing power source stalls due to excessive pump torque, and increasing operational life of implement systems. Operation of the disclosed systems and methods will now be explained.

A power source may be configured to provide a maximum torque output at a particular power source speed (i.e., torque limited). For example, a power source may have a maximum torque output of 500 Nm at a power source speed of 1500 RPM. Applying a torque greater than 500 Nm to the power source operating at 1500 RPM may cause the power source to cease operation (i.e., stall), among other things. Various speeds of the power source may have related maximum torque outputs and such data may be acquired experimentally. For example, power source 12 may have a maximum torque of 300 Nm at a speed of 850 RPM, and additional maximum torques for power source 12 may be determined experimentally throughout a range of power source speeds.

Implement systems associated with a machine may receive commands from an operator to undergo various motions with the goal of accomplishing a particular task. These motions may be limited by the assembly of linkages and hydraulic cylinders used to accomplish the motion. When a stop point is reached (e.g., end-of-travel point, linkage range of motion limit, mechanical safety stop, etc.), the corresponding stoppage of motion may cause a surge in the torque load applied by hydraulic pump 38 to power source 12 and may also result in additional vibrations and stresses to be transferred to machine 10, implement system 22, and power source 12. In some situations the resulting stresses and vibrations may be beneficial (e.g., banging a bucket to shake material loose), however, the resulting stresses and vibrations may produce undesirable results (e.g., long-term damage) within the various systems of machine 10 and discomfort to an operator of machine 10. Further, the resulting surge in torque load may cause power source 12 to stall, resulting in other complications. Because a power source may be torque limited and because it is preferred to minimize the detrimental effects of the associated torque load surge, methods for reducing such surges in torque applied to a power source may be beneficial.

Figure 3:
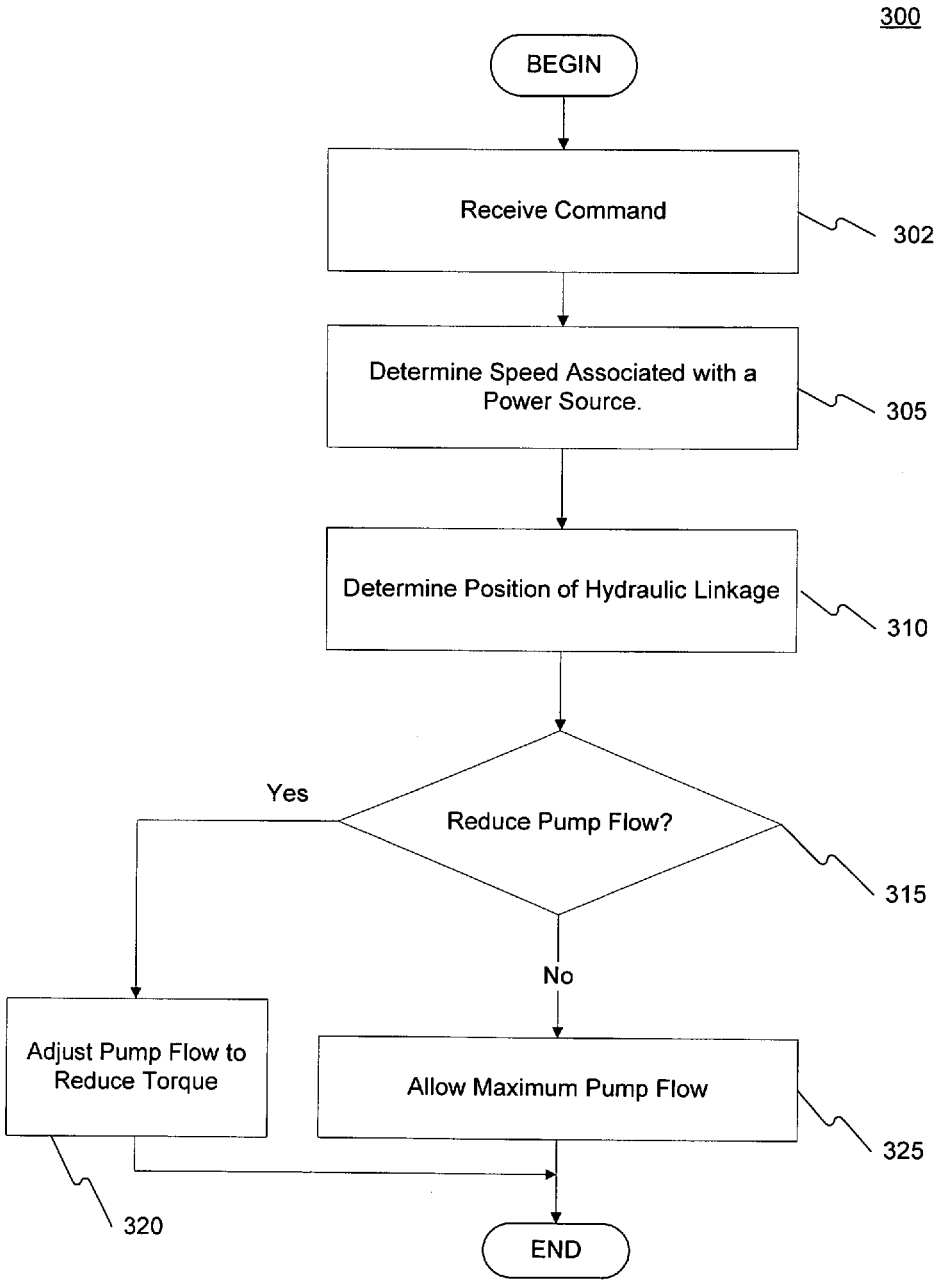
FIG. 3 is an exemplary flowchart illustrating one method for operating systems of the present disclosure.

FIG. 3 is an exemplary flowchart illustrating one method for limiting a torque load associated with an implement. Controller 42 may receive a command from joystick controller 82, or other suitable device, indicating that a flow of pressurized fluid should be directed to implement system 22 (step 302). Such a signal may be any level of command between full command (e.g., full fluid flow) and no command (e.g., no fluid flow). Controller 42 may then determine speed associated with power source 12 (step 305). For example, sensing mechanisms associated with power source 12 (e.g., a magnetic pickup mounted near the flywheel of power source 12) may provide information to controller 42 indicating power source 12 may be idling at 850 RPM and/or that a particular maximum load may be applied at such a power source speed without the risk of stalling power source 12.

Controller 42 may further receive information from sensors associated with implement system 22 and/or implement 24. For example, determining a position associated with implement system 22 and/or implement 24 may include receiving information related to positions and/or velocities associated with one or more hydraulic cylinders, linkage elements, implements, or other elements associated with implement system 22. Using this information, controller 42 may determine a positional proximity to a stop point associated with implement system 22 and/or implement 24 and compare this proximity to a predetermined range of proximities to stop points associated with implement system 22 and/or implement 24 (e.g., mechanical stops, range of motion limit, etc.) (step 310). The predetermined range may be measured in distance units (e.g., m), angular units (e.g., radians), or any other suitable positional units. When a particular positional proximity to a stop point associated with implement system 22 and/or implement 24 falls below a minimum, controller 42 may utilize an algorithm to determine whether a flow/command reduction should be implemented based on the current power source speed (step 315). For example, one algorithm may indicate that when power source 12 is operating below a predetermined threshold speed of about 900 RPM and a positional proximity to a stop point with implement system 22 falls below a minimum proximity, a reduction of fluid flow to implement system 22 should be performed (step 315: yes). Controller 42 may then affect a reduction of flow to implement system 22 (step 320).

Limiting or reducing a flow to implement system 22 may be accomplished by modifying a characteristic (e.g., current) of a control signal sent to flow-control assembly (not shown) causing the maximum available flow from hydraulic pump 38 to be reduced (e.g., reducing the swash plate angle). Alternatively, or in combination, controller 42 may modify the command signal sent to directional control valve 60 to cause an appropriate reduction in flow from directional control valve 60 to implement system 22. Such a reduction in flow and/or command may in turn slow the motion of implement system 22 while reducing the torque load that hydraulic pump 38 may apply to power source 12. This may allow power source 12 to more easily absorb the resulting reduced torque load surge when the motion of implement system 22 ceases (e.g., at end of travel or upon contacting a mechanical stop) and may limit the transfer of vibrations and stresses to machine 10. It is important to note that flow and/or command reduction to implement system 22 may be implemented on a progressive basis, e.g., as the determined position approaches an end-of-travel, greater flow reduction may be affected. Alternatively, full flow and/or command reduction may be affected immediately upon controller 42 determining the speed associated with power source 12 falls below the predetermined threshold speed and the position of implement system 22 falls within the predetermined range to end-of-travel.

Where controller 42 determines that no flow reduction should be affected (e.g., power source speed above the predetermined threshold speed and/or linkage position outside the predetermined range), controller 42 may allow maximum available flow and/or command (step 325). In one embodiment, this may be accomplished by maintaining a characteristic of the control signal such that flow control assembly (not shown) allows pump 38 to return to its maximum flow (e.g., reducing an electric current to solenoid valve 46). Alternatively, controller 42 may send a signal related to the actual command received from joystick controller 82 to directional control valve 60.

It is important to note that although the previous discussion involved lengths in mm, various other units of implement system 22 may be utilized to determine when flow/command reduction should be effected. For example, a predetermined range may be measured in degrees of implement angle, and may include measurements between 0 degrees and 10 degrees. In such an embodiment, where the power source speed is below the predetermined threshold speed (e.g., 900 RPM) and a bucket angle is between 0 degrees and 10 degrees of a stop point, controller 42 may effect a flow/command reduction as described. Further the amount of flow/command reduction may depend on a velocity of implement system 22 within the predetermined range. For example, where the power source speed is below the predetermined threshold speed (e.g., 900 RPM), a hydraulic cylinder piston associated with implement system 22 moves within the predetermined range of a stop point, and where the hydraulic cylinder piston is moving toward the end-of-travel point at between 1 mm/sec and 125 mm/sec, the amount of flow/command reduction may vary according to a particular mathematical formula. Where the same conditions are present but the hydraulic cylinder piston is moving toward the stop point at faster rate of 126 mm/sec to 150 mm/sec, flow/command reduction may be performed based on a different mathematical formula (e.g., a formula that more quickly reduces flow/command). Additionally, all stop points associated with implement system 22 and/or implement 24 may have a different predetermined ranges which may trigger flow reduction at a particular speed associated with power source 12. One of skill in the art will recognize that numerous other permutations may be utilized without departing from the scope of this disclosure.

An operator of machine 10 may be provided a method for terminating flow reduction to implement system 22 based on input from the operator. For example, where an operator wishes to "bang the bucket" at a power source speed below the predetermined threshold speed, the operator may utilize joystick controller 82 to input a predetermined control sequence to controller 42 (e.g., right, right, left). In such an example, upon receiving such a sequence, controller 42 may no longer modify characteristics of the control signal to cause flow reduction until flow reduction is re-enabled based on input of another specific sequence or default operation of controller 42 (e.g., after expiration of a time limit). One of skill in the art will recognize that numerous other sequences and methods for terminating flow reduction (e.g., an on/off switch) may be used without departing from the scope of the present disclosure.

Because the method and system of the present disclosure consider power source speed and implement linkage position in determining how and when to limit motion of the implement, operators may more fully utilize an implement at higher engine speeds without undesirable limitations near stop points. Further, stalls, vibrations, stresses, and operator strain may be reduced at lower engine speeds by implementing the systems and methods of the present disclosure.

It will be apparent to those skilled in the art that various modifications and variations can be made in the disclosed methods and systems without departing from the scope of the disclosure. Additionally, other embodiments of the method and system for controlling a variable torque pump will be apparent to those skilled in the art from consideration of the specification. It is intended that the specification and examples be considered as exemplary only, with a true scope of the disclosure being indicated by the following claims and their equivalents.

We claim:

1. A method for reducing a torque load associated with an implement, the method comprising:

determining a speed associated with a power source, wherein the power source is configured to provide power to a hydraulic pump;

determining a position associated with an implement system; and limiting a flow associated with the hydraulic pump based on the speed associated with the power source and the position associated with the implement system, wherein the limiting occurs when the speed associated with the power source falls below a predetermined threshold speed and the position associated with the implement system falls within a predetermined positional proximity of a stop point associated with the implement system.

2. The method of claim 1, wherein the determining the position associated with the implement system further includes determining a velocity associated with the implement system.

3. The method of claim 1, wherein the limiting includes reducing a command value to a hydraulic actuator associated with the implement system and the hydraulic pump.

4. The method of claim 1, wherein the limiting includes reducing a maximum potential flow from the hydraulic pump.

5. The method of claim 1, wherein the limiting ceases when the speed associated with the power source exceeds the predetermined threshold.

6. The method of claim 1, wherein the limiting may be terminated based on input from an operator.

7. A machine, comprising:

a frame;

a traction device;

a power source operatively connected to a hydraulic pump and configured to provide power to the hydraulic pump; and a controller configured to execute the method according to claim 1.

8. A system for reducing a torque load associated with an implement, the system comprising:

a controller communicatively connected to a power source, a first sensor configured to sense a speed associated with the power source, and a second sensor configured to sense a position of an implement system, wherein the power source is operatively connected to a hydraulic pump and configured to provide power to the hydraulic pump, and wherein the controller is configured to determine the speed associated with the power source based on input from the first sensor, determine the position associated with the implement system based on input from the second sensor, generate a signal based on the speed associated with the power source and the position associated with the implement system, wherein the signal affects a flow of fluid associated with the hydraulic pump; and affect the flow of fluid when the speed associated with the power source falls below a predetermined threshold speed and the position associated with the implement system falls within a predetermined positional proximity of a stop point.

9. The system of claim 8, wherein the signal is provided to an electro-hydraulic actuator fluidly connected to the implement system and the hydraulic pump.

10. The system of claim 8, wherein the signal is provided to an actuator operatively linked to a swash plate associated with the hydraulic pump, wherein the swash plate is configured to vary a maximum potential flow output from the hydraulic pump.

11. The system of claim 8, further including at least one sensor configured to sense a velocity of the implement system, wherein the at least one sensor is communicatively connected to the controller.

12. The system of claim 8, wherein the predetermined threshold speed is between about 600 RPM and about 850 RPM.

13. The system of claim 8, wherein the controller is further configured to cease affecting the flow of fluid when the speed associated with the power source rises above a predetermined threshold speed.

14. The system of claim 8, wherein the controller is further configured to cease affecting the flow of fluid upon receiving a predetermined command sequence from an operator.

15. A method of limiting the motion of a hydraulic cylinder on a machine, the method comprising:

sensing a speed associated with a power source, wherein the power source is related to a machine and configured to drive a hydraulic pump associated with the machine;

sensing a position associated with an implement system, wherein the implement system is associated with the machine, a hydraulic cylinder, and the hydraulic pump;

receiving a command to provide a flow of fluid from the hydraulic pump to the implement system to impart motion to the implement system; and reducing the flow of fluid from the hydraulic pump, resulting in a reduced velocity of the implement system, when the speed associated with the power source falls below a power source speed threshold and the position associated with the system falls within a predetermined positional proximity of a stop point associated with the implement system.

16. The method of claim 15, wherein the reducing includes limiting the flow through an electro-hydraulic actuator fluidly connected to the implement system and the hydraulic pump.

17. The method of claim 15, wherein the reducing is further affected based on a velocity of the implement system.

18. The method of claim 15, wherein the reducing ceases upon receiving a predetermined command sequence from an operator.

* * * * *